US007389827B2

(12) United States Patent
Biehl

(10) Patent No.: US 7,389,827 B2
(45) Date of Patent: Jun. 24, 2008

(54) NOZZLE ASSEMBLY WITH BLOW-OFF CAP FOR USE IN FIRE SUPPRESSION SYSTEM

(75) Inventor: Richard J. Biehl, Marinette, WI (US)

(73) Assignee: Ansul Incorporated, Marinette, WI (US)

( * ) Notice: Subject to any disclaimer, the term of this patent is extended or adjusted under 35 U.S.C. 154(b) by 125 days.

(21) Appl. No.: 11/268,919

(22) Filed: Nov. 8, 2005

(65) Prior Publication Data

US 2006/0272832 A1 Dec. 7, 2006

Related U.S. Application Data

(60) Provisional application No. 60/683,673, filed on May 23, 2005.

(51) Int. Cl.
*A62C 3/00* (2006.01)

(52) U.S. Cl. ..... 169/65; 169/9; 169/16; 169/26; 169/37; 169/51; 239/288; 239/288.5; 239/DIG. 4

(58) Field of Classification Search ..... 169/9, 169/11, 16, 19, 26, 37, 51, 65; 239/288, 239/288.3, 288.5, DIG. 4
See application file for complete search history.

(56) References Cited

U.S. PATENT DOCUMENTS 2,327,528 A 8/1943 Kendall et al.
5,351,760 A * 10/1994 Tabor. Jr. ..... 169/65
5,501,282 A 3/1996 Sundholm
5,570,745 A * 11/1996 MacDonald, III ..... 239/288.5
6,347,669 B1 2/2002 Sundholm

FOREIGN PATENT DOCUMENTS

JP 09 276433 10/1997
WO WO 03/105962 A1 12/2003

OTHER PUBLICATIONS

Mark Neumann, New CB Metal Blow-Off Cap for Chain Broiler Applications, General Bulletin No. 4925, Feb. 16, 2005, ANSUL, Tyco Safety Products, Marinette, WI, USA.
GW Sprinkler A/S, GW Commercial Fat Fryer Sprinkler Protection System, Manual No. 815, Feb. 4, 2004, p. 23 of 41, Ref. No. 815, GW Sprinkler A/S, Glamsbjerg, Denmark.

* cited by examiner

*Primary Examiner*—Steven J Ganey
(74) *Attorney, Agent, or Firm*—The Small Patent Law Group

(57) ABSTRACT

A discharge assembly used with a fire suppression delivery system comprises a nozzle having an outer nozzle surface and inlet and discharge ends. The inlet end receives fire suppression agent and the discharge end dispenses fire suppression agent through an orifice. A blow-off cap has an open-ended cavity shaped to receive the discharge end of the nozzle and cover the orifice. The cavity includes an interior cap surface located in close proximity to the outer nozzle surface of the nozzle when the blow-off cap is mounted on the discharge end of the nozzle. A receptacle is formed in at least one of the outer nozzle surface of the nozzle and the interior cap surface of the blow-off cap. A retention element fits within the receptacle and engages the outer nozzle surface and interior cap surface, providing a predetermined amount of retention resistance to retain the blow-off cap on the nozzle.

24 Claims, 7 Drawing Sheets

NOZZLE ASSEMBLY WITH BLOW-OFF CAP FOR USE IN FIRE SUPPRESSION SYSTEM

CROSS REFERENCE TO RELATED APPLICATIONS

The application relates to and claims priority from provisional patent application Ser. No. 60/683,673, titled "CB BLOW-OFF CAP", filed May 23, 2005, the complete subject matter of which is expressly hereby incorporated herein in its entirety.

BACKGROUND OF THE INVENTION

This invention relates generally to fire suppression systems used in buildings, restaurants and other commercial kitchens, and more particularly, to blow-off caps used on nozzles within the fire suppression systems.

Fire suppression systems provide an integral service to commercial kitchens, which use multiple cooking appliances (e.g. chain broilers, deep fryers, broilers, cook tops, and the like) to cook large quantities of food. The cooking appliances are often operated at high temperatures for extended periods of time, creating a large amount of grease and other effluent.

Fire suppression components are located over the top of the cooking appliances, aimed inside partially enclosed cooking appliances, and are within hoods and ducts associated with the exhaust system. When a hazardous condition is detected, a fire suppression agent is discharged through a nozzle to eliminate the hazardous condition. The fire suppression agent may be, for example, a chemical agent, water, or a combination of the two.

Due to the large amount of effluent present in the location of the nozzles, clogging of the orifice or orifices through which the fire suppression agent is discharged needs to be prevented so that the system activates correctly when needed. A cap is therefore affixed to the nozzle. The cap is to be blown or pushed off the nozzle, or broken or burst, by the pressure created when fire suppression agent is discharged.

A silicone rubber cap has been used to cover the end of the nozzle. However, the rubber cap deteriorates due to effluent build up and the high temperature experienced in the exhaust area over broilers and other cooking units. A brass cap held onto the nozzle with a retaining clip has also been used. The retaining clip weakens over time due to, for example, the extreme temperature gradients, allowing the cap to fall off the nozzle. Also, grease accumulates inside the cap and nozzle, effectively freezing the cap onto the nozzle and/or clogging the orifice.

Therefore, a need exists for a blow-off cap and nozzle assembly capable of withstanding the extreme conditions experienced in commercial kitchen applications, while still allowing the blow-off cap to be pushed off the nozzle during a fire discharge situation. Certain embodiments of the present invention are intended to meet these needs and other objectives that will become apparent from the description and drawings set forth_below.

BRIEF DESCRIPTION OF THE INVENTION

In one embodiment, a discharge assembly for use with a fire suppression delivery system comprises a nozzle having an outer nozzle surface. The nozzle also has an inlet end configured to receive a fire suppression agent and a discharge end with an orifice therein to dispense the fire suppression agent in a desired manner. A blow-off cap has an open-ended cavity shaped to receive the discharge end of the nozzle and to cover the orifice. The cavity includes an interior cap surface that is located in close proximity to the outer nozzle surface of the nozzle when the blow-off cap is mounted on the discharge end of the nozzle. A receptacle is formed in at least one of the outer nozzle surface of the nozzle and the interior cap surface of the blow-off cap. A retention element is fit within the receptacle and engages the outer nozzle surface and the interior cap surface to provide a predetermined amount of retention resistance to retain the blow-off cap on the nozzle.

In another embodiment, a blow-off cap for use on a nozzle in a fire suppression system comprises a cover and an O-ring. The nozzle has an outer nozzle surface and inlet and discharge ends. The inlet end is configured to receive a fire suppression agent and the discharge end has an orifice therein to dispense the fire suppression agent in a desired manner. The cover of the blow-off cap comprises a cavity configured to receive the discharge end of the nozzle. The O-ring is fixed within the cavity and is snappingly received over the outer nozzle surface. The O-ring and nozzle provide resistance to retain the blow-off cap on the nozzle until a system pressure builds up sufficient to push the blow-off cap off the nozzle.

In another embodiment, a fire suppression system comprises a fire suppression delivery system for delivering fire suppression agent. A nozzle has an outer nozzle surface and inlet and discharge ends. The inlet end is configured to receive the fire suppression agent and the discharge end has an orifice therein to dispense the fire suppression agent in a desired manner. A blow-off cap has an open-ended cavity shaped to receive the discharge end of the nozzle and to cover the orifice. The cavity includes an interior cap surface that is located in close proximity to the outer nozzle surface of the nozzle when the blow-off cap is mounted on the discharge end of the nozzle. A receptacle is formed in at least one of the outer nozzle surface of the nozzle and the interior cap surface of the blow-off cap. A retention element is fit within the receptacle and engages the outer nozzle surface and the interior cap surface to provide a predetermined amount of retention resistance to retain the blow-off cap on the nozzle.

The foregoing summary, as well as the following detailed description of certain embodiments of the present invention, will be better understood when read in conjunction with the appended drawings. It should be understood that the present invention is not limited to the arrangements and instrumentality shown in the attached drawings.

DETAILED DESCRIPTION OF THE INVENTION

Figure 1:
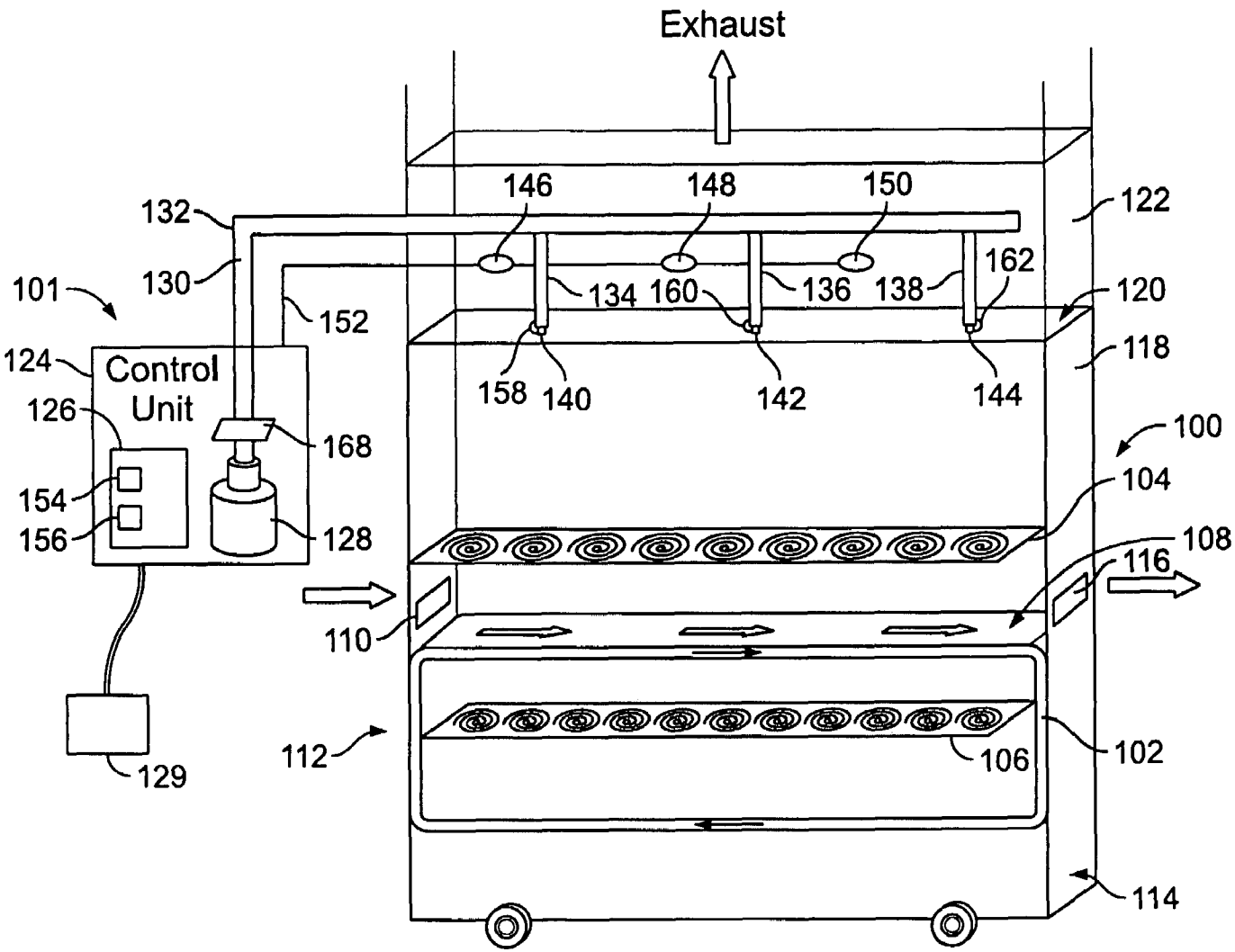
FIG. 1 illustrates a fire suppression delivery system and a chain broiler needing overhead broiler protection.

FIG. 1 illustrates a fire suppression delivery system 101 and a chain broiler 100 needing overhead broiler protection. The chain broiler 100 has a chain 102 or other moving belt with a surface 108 which is moved laterally between a top broiler unit 104 and a bottom broiler unit 106. The surface 108 of the chain 102 may be accessed through an access window 110 on a first end 112 of the chain broiler 100. The chain 102 moves a food item placed on the surface 108, such as a hamburger or piece of chicken, from the first end 112 to a second end 114 of the chain broiler 100, cooking the food item with the top and bottom broiler units 104 and 106. The food item is removed at the second end 114 through a second access window 116. The chain broiler 100 has an outer cover 118 which retains heat, protects users from burns, grease spatters and effluent, and provides a barrier between the environment and the components of the chain broiler 100.

The chain broiler 100 has an open or substantially open top end 120 to exhaust effluent. The open top end 120 is placed beneath an exhaust hood 122, which is connected to an exhaust duct within an exhaust system. The exhaust system may provide ventilation for multiple areas within a kitchen, such as additional hoods, chain broilers, upright broilers, ovens and the like.

The fire suppression delivery system 101 uses a number of interconnected controls, panels, pipes, tanks, bottles, nozzles, blow-off caps, detectors and the like. The fire suppression delivery system 101 may be designed based on the cooking appliances it will be used with. A hazard zone, such as a flat, level and/or rectangular surface including all of the cooking hazards of the protected appliances under the hood or hoods, may be defined when designing the number, flow, location and aiming of the nozzles. Fire suppression is provided to the hazard zone as well as to the hood 122 and other locations within the exhaust system.

A control unit 124 is located near the hood 122 and provides a control panel 126 to allow operation of the fire suppression delivery system 101. The control panel 126 may be accessible from the outside of the control unit 124, or may be behind a door or window. The control panel 126 provides controls to a user, such as an on/off switch 154 and a manual activation switch 156 for manually activating fire suppression. Alternatively, emergency control of the fire suppression delivery system 101 may be provided simply through a manual pull station and a fuel shut off.

One or more bottles 128 of fire suppression agent may be installed within the control unit 124, a separate enclosure, or affixed to a wall or other location. A water source 129 may also be supplied to the fire suppression delivery system 101. The bottle 128 is connected to a pipe 130, hose or other conduit suitable for carrying the fire suppression agent and able to withstand hot and fluctuating temperatures. An actuator 168 may be connected to the bottle 128 or between the bottle 128 and the pipe 130. The pipe 130 extends out of the control unit 124. The pipe 130 is bent in one or more locations, if necessary, such as at elbow 132, and extends into the hood 122. The water source 129 may also be connected to the actuator 168 and allowed to flow through pipe 130, or may be connected to a second actuator and pipe (not shown)

One or more nozzles 134, 136 and 138 are interconnected to the pipe 130 and may be positioned uniformly under the hood 122 from the first end 112 of the chain broiler 100 to the second end 114. The nozzles 134-138 are configured to dispense the fire suppression agent through one or more orifices. Each of the nozzles 134-138 has a flow rating, angle of coverage, and/or spray pattern, and the type and configuration of nozzles 134-138 may vary. For example, both nozzles 134 and 136 may provide a wide angle of coverage while the nozzle 134 has a flow rating of 1 and the nozzle 136 has a flow rating of 2.

A blow-off cap 140, 142 and 144 is installed on each of the nozzles 134, 136, and 138, respectively. The blow-off caps 140-144 cover the orifice(s) on the nozzles 134-138, each forming a discharge assembly which prevents the nozzles 134-138 from clogging with grease and/or other effluent. It should be understood that additional nozzles 134-138 and blow-off caps 140-144 may be installed to provide protection to other ventilation equipment such as ducts, plenums and filters.

One or more detectors 146, 148 and 150 may be connected to the control unit 124 by way of one or more wires 152. The detectors 146-150 detect a condition that needs to be suppressed, such as a fire, excess smoke, or heat beyond an acceptable limit, and report the condition to the control unit 124. Other methods of detection may be used.

When the detectors 146-150 detect a condition or the manual activation switch 156 is activated, the control unit 124 opens the connection between the bottle 128 and the pipe 130, such as by energizing the actuator 168. The fire suppression agent discharges into the pipe 130 at a minimum pressure. The fire suppression agent enters each of the nozzles 134-138 and applies a system pressure to each blow-off cap 140-144 through the orifice. When the system pressure builds up to a sufficient level, the blow-off cap 140-144 is pushed off the nozzle 134-138. The fire suppression agent is discharged out of the orifices of the nozzles 134-138, into the hood 122 and the top end 120 of the chain broiler 100. By way of example only, the blow-off caps 140-144 may be designed to blow off the nozzles 134-138 when experiencing system pressure within a range or predetermined limit or limits, such as above a minimum preset pressure. The blow-off caps 140-144 stay connected to the respective nozzles 134-138 through a lanyard 158, 160 and 162, chain or other device after a fire discharge situation.

One or more fire suppression agents may be used. For example, a fixed amount of wet chemical agent from the bottle 128 may be discharged through the nozzles 134-138. Alternatively, following the discharge of a wet chemical agent, water from the water source 129 may be discharged through the nozzles 134-138, such as in a hybrid system. Alternatively, a clean extinguishing agent may be used instead of a wet chemical agent. A clean extinguishing agent, such as a liquefied gas product, is discharged out of the nozzle 134-138 as a liquid and then vaporizes. Optionally, a foam based agent may be used. One or more nozzles may be used to supply the fire suppression agent while the remaining nozzles are used to supply water. Optionally, a dry chemical agent may by applied using a first set of nozzles while a second set of nozzles apply water.

Figure 2:
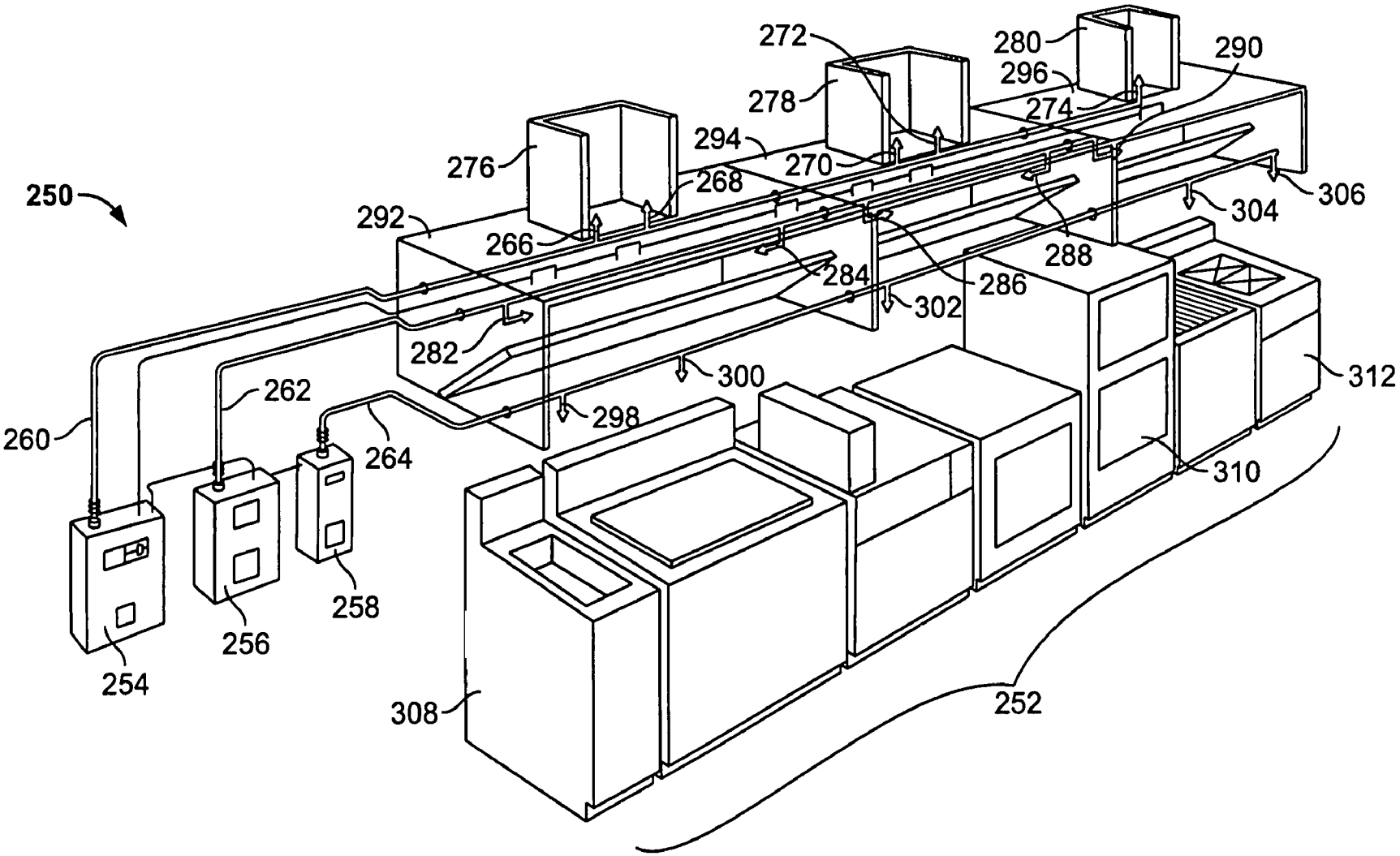
FIG. 2 illustrates an alternative fire suppression delivery system and an appliance line.

FIG. 2 illustrates an alternative fire suppression delivery system 250 and an appliance line 252. The appliance line 252 may be formed of cooking appliances such as a deep fryer 308, broiler or oven 310 and cook top 312. The fire suppression delivery system 250 is provided with three tanks, sources or bottles 254, 256 and 258 of fire suppression agent. As discussed previously, the same or different fire suppression agents may be used. Each of the bottles 254, 256 and 258 is connected to a pipe 260, 262 and 264, respectively. Arrows indicate possible placement and discharge direction for assemblies of nozzles and blow-off caps. Discharge assemblies 266, 268, 270, 272 and 274 are connected to pipe 260 and discharge into exhaust ducts 276, 278 and 280. Discharge assemblies 282, 284, 286, 288 and 290 may be connected to pipe 262 and discharge into hoods 292, 294 and 296. Discharge assemblies 298, 300, 302, 304 and 306 may be connected to pipe 264 and discharge over the appliance line 252 into the hazard zone. The discharge assemblies may be positioned uniformly or non-uniformly from one end of the appliance line 252 to the other. Each discharge assembly in FIG. 2 includes a nozzle and a blow-off cap.

Figure 3:
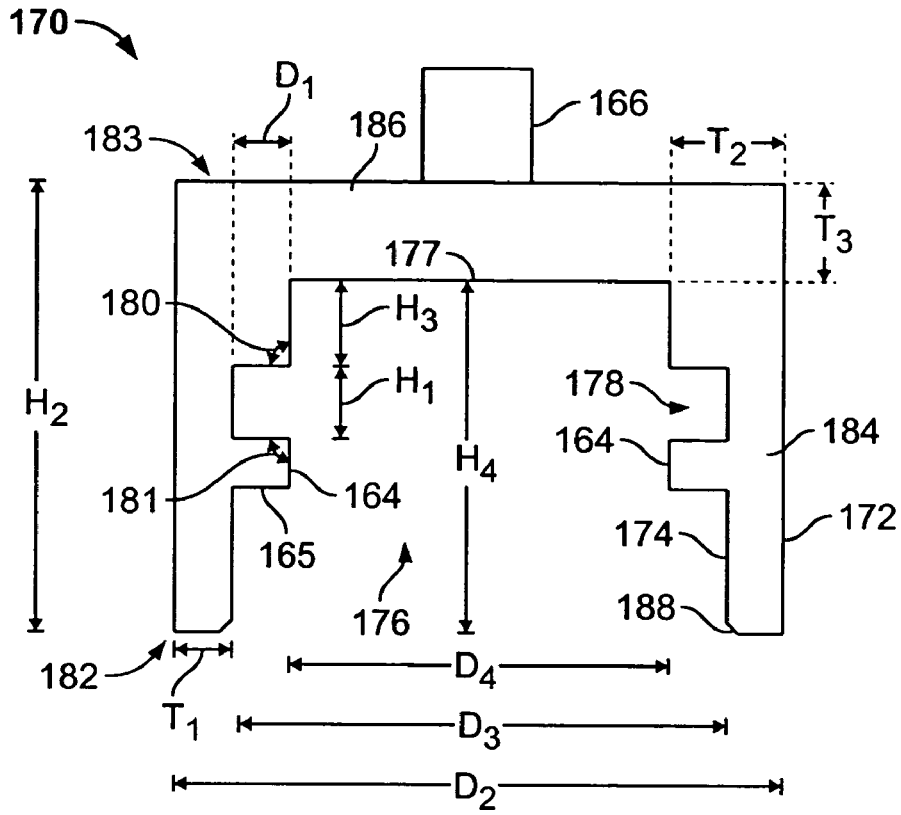
FIG. 3 illustrates a cross-section of a cover of the blow-off cap in accordance with an embodiment of the present invention.

FIG. 3 illustrates a cross-section of a cover 170 for a blow-off cap (such as blow-off cap 140, 142, 144) in accordance with an embodiment of the present invention. The cover 170 is made of metal or other material able to withstand the temperature gradients produced by the chain broiler 100 or appliance line 252. The cover 170 has a circular wall portion 184, a closed end portion 186, a height $H_2$ and an outer diameter $D_2$. A stem 166 extends from the closed end portion 186 and is discussed further below. The circular wall portion 184 and closed end portion 186 have outer and interior cap surfaces 172 and 174, and form an open-ended cavity 176 for accepting the nozzle 134 (FIG. 1). The cavity 176 has a height $H_4$, a first diameter $D_3$, a second diameter $D_4$, and a closed end 177.

The wall portion 184 has a thickness $T_1$ at a first end 182 and a thickness $T_2$ at a second end 183. The wall portion 184 may have a beveled inner edge 188 along the first end 182. A receptacle 178 with a depth $D_1$ and a height $H_1$ is formed in the cavity 176, starting at a height $H_3$ from the interior cap surface 174 of the closed end 177. The receptacle 178 forms a first angle 180 with the interior cap surface 174 and a second angle 181 with a protrusion 164. First and second angles 180 and 181 may be approximately 90 degrees. The receptacle 178 may be a groove which retains a retention element, such as an O-ring. The depth $D_1$ and the height $H_1$ may vary depending upon the size of the retention element or O-ring, operating pressures of the fire suppression delivery system 101, and the like. It should be understood that the details illustrated and discussed in FIG. 3 are optional, and that a cover 170 may be formed having details different from those shown. Additionally, the diameters, height and width relationships may vary and are not limited to the relationships illustrated. Furthermore, the overall shape of the cover may vary.

Figure 4:
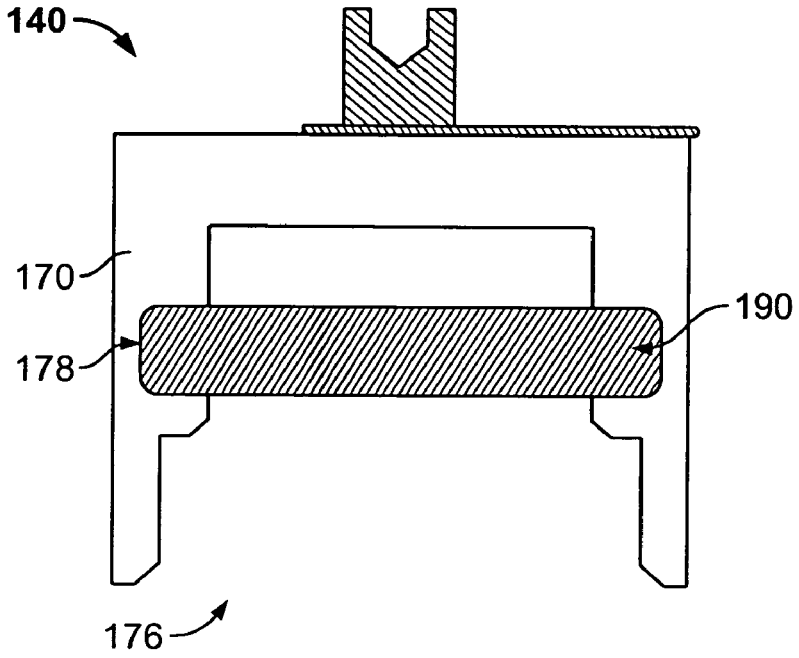
FIG. 4 illustrates a view of the blow-off cap with a retention element installed within the cover in accordance with an embodiment of the present invention.

FIG. 4 illustrates a view of the blow-off cap 140 with a retention element installed within the cover 170 in accordance with an embodiment of the present invention. The retention element may constitute an O-ring 190, which is inserted into the cavity 176 of the cover 170 and securely retained by the receptacle 178.

Figure 5:
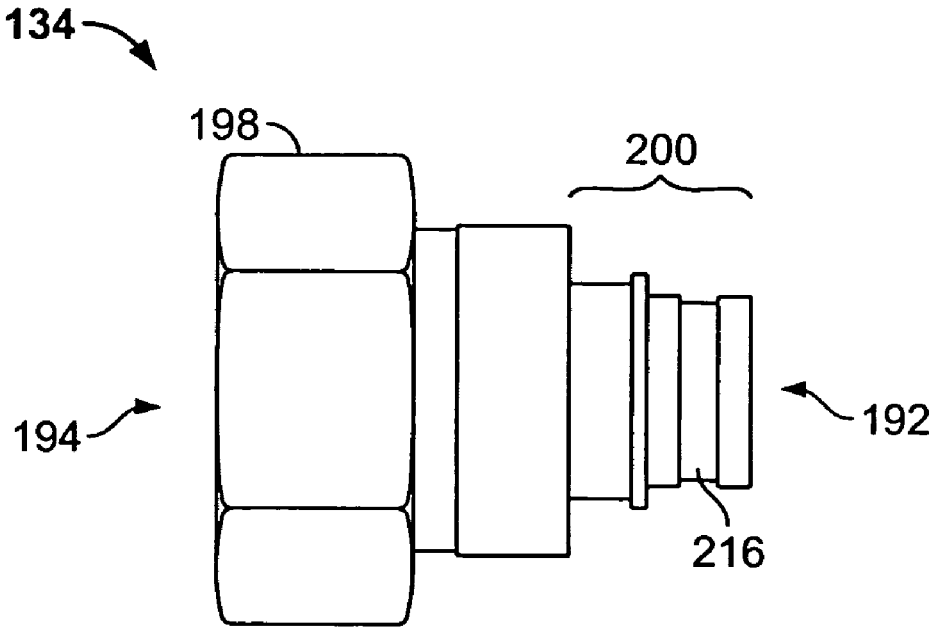
FIG. 5 illustrates a side view of the nozzle in accordance with an embodiment of the present invention.

FIG. 5 illustrates a side view of the nozzle 134 in accordance with an embodiment of the present invention. The nozzle 134 has a discharge end 192 and an inlet end 194. The inlet end 194 is interconnected with the pipe 130 (FIG. 1) such as with a nut 198, press fitting, or other connector. Towards the discharge end 192, the nozzle 134 has a cap receiving portion 200 with an outer nozzle surface 216. The cap receiving portion 200 is inserted into the cavity 176 of the cover 170. The nozzle 134 is made of metal and has a channel (not shown) formed within for conveying fire suppression agent received from the pipe 130 at the inlet end 194 to an orifice at the discharge end 192.

Figure 6:
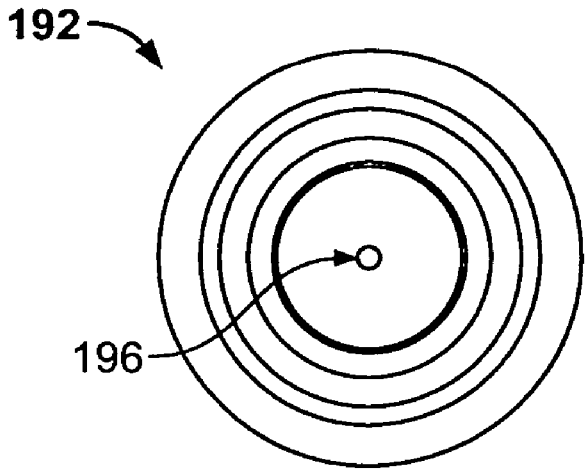
FIG. 6 illustrates the discharge end of the nozzle in accordance with an embodiment of the present invention.

FIG. 6 illustrates the discharge end 192 of the nozzle 134 in accordance with an embodiment of the present invention. The discharge end 192 has one or more orifices 196 in communication with the channel. The suppression agent is released through the orifice 196.

Figure 7:
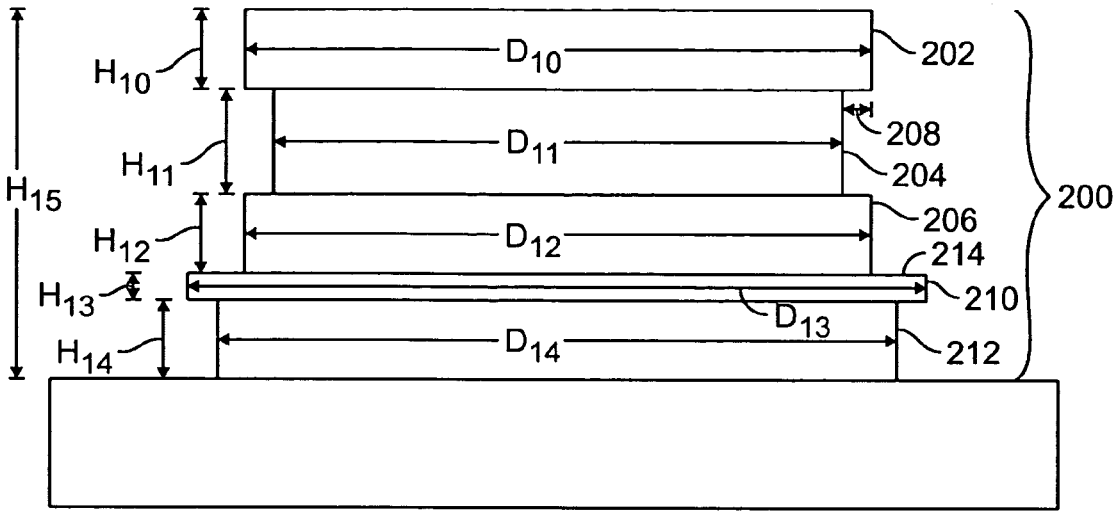
FIG. 7 illustrates a side view of the cap receiving portion of the nozzle in accordance with an embodiment of the present invention.

FIG. 7 illustrates a side view of the cap receiving portion 200 of the nozzle 134 in accordance with an embodiment of the present invention. The cap receiving portion 200 may be formed of a single piece of material and has a first portion 202, a receptacle 204, second and third portions 206 and 210, and a recess 212. The first portion 202 has a diameter $D_{10}$ and a height $H_{10}$. Referring also to FIG. 3, the diameter $D_{10}$ is substantially equal to or slightly less than the diameter $D_4$ of the cavity 176, and the height $H_{10}$ is substantially equal to, or slightly less than, the height $H_3$.

The receptacle 204 may be formed adjacent the first portion 202 as a groove having a diameter $D_{11}$ and a height $H_{11}$. The receptacle 204 is configured to snappingly receive the O-ring 190 (FIG. 4) when the nozzle 134 is inserted into the cavity 176 of the cover 170. The second portion 206 is formed adjacent the receptacle 204, and has a diameter $D_{12}$ and a height $H_{12}$. The diameter $D_{12}$ is substantially equal to or slightly less than the diameter $D_4$ of the cavity 176 and the diameter $D_{10}$ of the first portion 202. The diameter $D_{11}$ of the receptacle 204 is less than each of the diameters $D_{10}$ and $D_{12}$ by a depth 208. The depth 208 is determined by at least one of the size, width or thickness of the O-ring 190 and the amount of pressure required to push the blow-off cap 140 off the nozzle 134 during a fire discharge situation.

The third portion 210 is formed adjacent the second portion 206 and has a diameter $D_{13}$ and a height $H_{13}$. The diameter $D_{13}$ is substantially equal to or slightly less than the diameter $D_3$. A surface 214 of the third portion 210 is configured to rest against a surface 165 of the protrusion 164. The recess 212 has a diameter $D_{14}$ and a height $H_{14}$ which may be varied depending upon the height $H_4$ of the cavity 176. Therefore, a total height $H_{15}$ of the cap receiving portion 200 is substantially equal to, or slightly greater than, the height $H_4$. The recess 212 may be configured to receive an interconnecting member attached to the blow-off cap 140. As stated previously with FIG. 3, the details and dimensions of the cap receiving portion 200 of the nozzle 135 illustrated in FIG. 7 are exemplary, and thus may vary and are not limited to the relationships shown.

Figure 8:
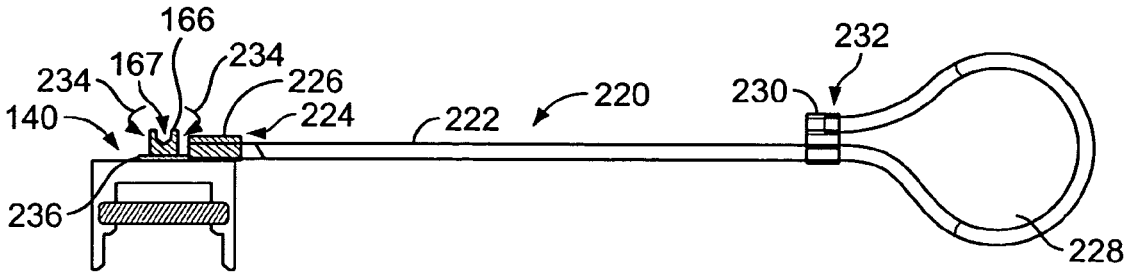
FIG. 8 illustrates a cross-section of the blow-off cap having an interconnected lanyard in accordance with an embodiment of the present invention.

FIG. 8 illustrates a cross-section of the blow-off cap 140 having an interconnected lanyard 220 in accordance with an embodiment of the present invention. The lanyard 220 may be formed of a wire 222, metal mesh, chain, or other material capable of withstanding the extreme heat experienced within the chain broiler 100 and the appliance line 252. A small loop 236 is formed in a first end 224 of the wire 222 and held by a crimp 226. The loop 236 is then preened or pressed over the stem 166. The stem 166 may be formed with a cavity 167 or hole therein. The outer edge of the stem 166 may be rolled outward and down in the direction of arrows 234, retaining the loop 236 on the stem 166. Alternatively, a clip (not shown) may be attached to stem 166 and the wire by the crimp 226. The loop 236 or clip attached to or pressed over the stem 166 may be free to swivel. A second, larger loop 228 is formed in a second end 232 of the wire 222. The loop 228 interconnects with the nozzle 134, such as along recess 212, so that the blow-off cap 140 is retained by the nozzle 134 after the fire suppression delivery system 101 has activated.

Figure 9:
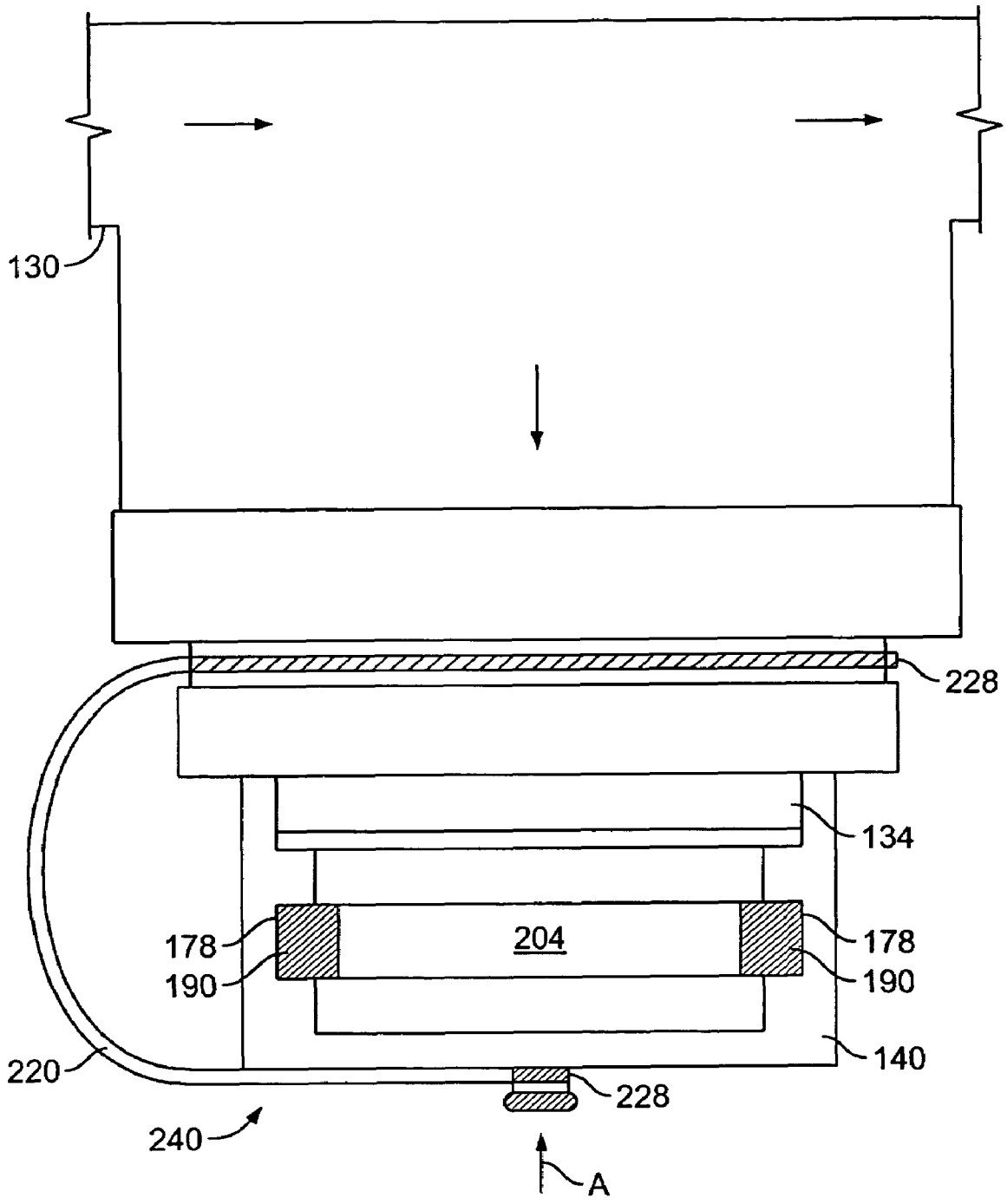
FIG. 9 illustrates a cross-section of an assembly of the blow-off cap and the nozzle in accordance with an embodiment of the present invention.

FIG. 9 illustrates a cross-section of a discharge assembly 240 of the blow-off cap 140 and the nozzle 134 in accordance with an embodiment of the present invention. The O-ring 190 is installed in the receptacle 178 in the cavity 176 of the blow-off cap 140. The blow-off cap 140 is pushed onto the nozzle 134 in the direction of arrow A, inserting the cap receiving portion 200 of the nozzle 134 into the cavity 176 until the O-ring 190 is snappingly received by the receptacle 204 in the nozzle 134. Thus, the interior cap surface 174 (FIG. 3) is in close communication with the outer nozzle surface 216 (FIG. 5). The O-ring 190 and receptacles 178 and 204 create a seal within the discharge assembly 240, preventing grease and effluent from building up inside the blow-off cap 140, freezing the blow-off cap 140 to the nozzle 134, and/or clogging the orifice 196 (FIG. 6).

A puff test may be conducted to ensure that the blow-off cap 140 is pushed off the nozzle 134 at the appropriate system or discharge pressure, and may be measured in pressure per square inch (psi). Therefore, the receptacles 178 and 204 and retention element or O-ring 190 provide a predetermined amount of retention resistance to retain the blow-off cap 140 on the nozzle 134. The discharge pressure range may be based on the normal operation of the fire suppression delivery system 101. For example, the fire suppression delivery system 101 may be set to operate normally between 45 and 65 psi, that is, the pressure range experienced at the nozzle 134 during a fire discharge situation will be between 45 and 65 psi. The discharge assembly 240 may be designed to separate at, by way of example only, 50 psi. Thus, when the system pressure builds up to the sufficient level of 50 psi, the blow-off cap 140 is pushed off the nozzle 134.

The receptacle 204 retains the blow-off cap 140 on the nozzle 134 under the defined system conditions. The discharge pressure needed to push the blow-off cap 140 off the nozzle 134 may be refined by adjusting the size of one or both of the receptacles 178 and 204. For example, by increasing the depth 208 (FIG. 7) and/or the height $H_{11}$ of the receptacle 204, more pressure is needed to push the blow-off cap 140 off the nozzle 134. Alternatively, an O-ring 190 or other retention element having a different diameter, thickness or physical properties may be used.

In addition, a minimum operating limit or range may be established, ensuring that the discharge assembly 240 withstands a predetermined level of vibration. By way of example only, a vibration test using 0.06 inches of displacement at 10 hertz for 8 hours may be conducted during which it is verified that the blow-off cap 140 stays on the nozzle 134. The discharge assembly 240 is also designed to withstand hot and cold temperature gradients experienced during cooking operations, such as fluctuations between 70 degrees and 200 degrees. Optionally, a single receptacle may be formed in either the blow-off cap 140 or nozzle 134 to retain the O-ring 190. The receptacle may be adjusted in height, width, and/or diameter to adjust the retention resistance of the discharge assembly.

Figure 10:
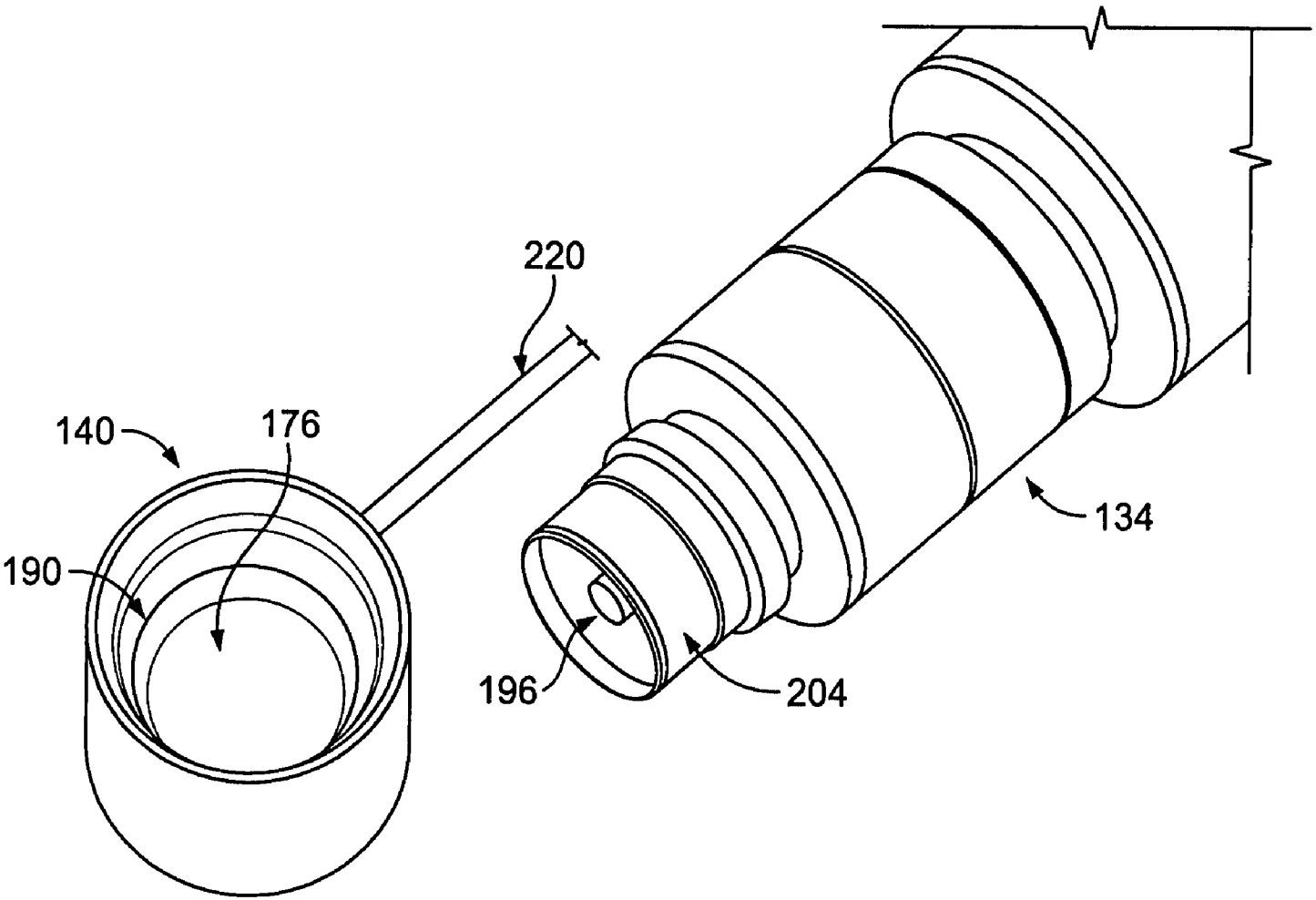
FIG. 10 illustrates the nozzle and the blow-off cap in accordance with an embodiment of the present invention.

FIG. 10 illustrates the nozzle 134 and the blow-off cap 140 in accordance with an embodiment of the present invention. The lanyard 220 is connected to the blow-off cap 140, and the O-ring 190 is installed in the receptacle 178 inside the cavity 176. The receptacle 204 on the nozzle 134 accepts the O-ring 190, and retains the blow-off cap 140 in place. When the fire suppression delivery system 101 is activated, the discharge pressure created at the orifice 196 is great enough to overcome the retention resistance and push the blow-off cap 140 off the nozzle 134. Fire suppression agent is discharged through the orifice 196.

While the invention has been described in terms of various specific embodiments, those skilled in the art will recognize that the invention can be practiced with modification within the spirit and scope of the claims.

What is claimed is:

1. A discharge assembly for use with a fire suppression delivery system, comprising:

a nozzle having an inlet end configured to receive a fire suppression agent and having a discharge end with an orifice therein to dispense the fire suppression agent in a desired manner, the nozzle having an outer nozzle surface;

a blow-off cap having a closed end portion and wall portion that together form an open-ended cavity shaped to receive the discharge end of the nozzle and cover the orifice, the closed end portion including a closed end that is located in close proximity to the orifice of the nozzle when the blow-off cap is mounted on the discharge end of the nozzle such that the orifice directs the fire suppression agent directly onto the closed end portion;

a receptacle having a first groove formed in the outer nozzle surface of the nozzle and having a second groove formed in an interior cap surface of the wall portion of the blow-off cap; and a retention element fit within the first and second grooves of the receptacle and engaging the outer nozzle surface and the interior cap surface to provide a predetermined amount of retention resistance to retain the blow-off cap on the nozzle.

2. The discharge assembly of claim 1, wherein the retention element constitutes an O-ring that provides a seal to prevent grease from entering the nozzle.

3. The discharge assembly of claim 1, wherein the retention element constitutes an O-ring fitted into the second groove in the interior cap surface of the wall portion prior to mounting the blow-off cap onto the discharge end of the nozzle.

4. The discharge assembly of claim 1, further comprising a lanyard having first and second ends, the first end being fastened to the blow-off cap and the second end being fastened to the nozzle.

5. The discharge assembly of claim 1, wherein the receptacle grooves have a depth based on at least one of a thickness of the retention element and a discharge pressure.

6. The discharge assembly of claim 1, wherein the blow-off cap is formed of metal.

7. The discharge assembly of claim 1, wherein the blow-off cap and nozzle retain communication after the fire suppression delivery system pushes the blow-off cap off the nozzle.

8. The discharge assembly of claim 1, wherein the discharge assembly is configured to be positioned proximate a cooking appliance, the wall portion and closed end portion being formed of a single piece of metal that remains rigid and withstands extreme temperature gradients produced by the cooling appliance.

9. The discharge assembly of claim 1, wherein the closed end portion and wall portion of the cover are formed from a single piece of material able to withstand extreme temperature conditions experienced in commercial kitchen appliances, such that the retention member and first and second grooves maintain the predetermined amount of retention resistance when exposed to the extreme temperature conditions experienced in commercial kitchen appliances.

10. A blow-off cap for use on a nozzle in a fire suppression system, the nozzle having an inlet end configured to receive a fire suppression agent and having a discharge end with an orifice therein to dispense the fire suppression agent in a desired manner, the nozzle having an outer nozzle surface with an outer groove therein, the blow-off cap comprising:

a cover with a closed end portion and wall portion that together form a cavity being configured to receive the discharge end of the nozzle, the wall portion including an interior cap surface that includes an interior groove; and an O-ring fixed within the interior groove in the interior cap surface of the cavity before mounting the cover on the nozzle, the O-ring being snappingly received over the outer nozzle surface into the outer groove as the cover is mounted on the nozzle, the O-ring and interior and outer grooves providing a predetermined amount of retention resistance to retain the blow-off cap on the nozzle until a system pressure builds up sufficient to push the blow-off cap off the nozzle.

11. The blow-off cap of claim 10, wherein the O-ring provides a seal to prevent grease from entering the nozzle.

12. The blow-off cap of claim 10, the interior groove having a depth and height based on at least one of an O-ring size and a discharge pressure.

13. The blow-off cap of claim 10, wherein the cover is formed of metal.

14. The blow-off cap of claim 10, the cover further comprising the closed end portion formed with the wall portion, the closed end portion including a closed end that is located in close proximity to the orifice of the nozzle when the blow-off cap is mounted on the discharge end of the nozzle such that the orifice directs the fire suppression agent directly onto the closed end portion.

15. The blow-off cap of claim 10, wherein the fire suppression system is configured for use in a cooking appliance , the wall portion and closed end portion being formed of a single piece of metal that remains rigid and withstands extreme temperature gradients produced by the cooking appliance.

16. The blow-off cap of claim 10, wherein the closed end portion and wall portion of the cover are formed from a single piece of material able to withstand extreme temperature conditions experienced in commercial kitchen appliances, such that the O-ring and interior and outer grooves maintain the predetermined amount of retention resistance when exposed to the extreme temperature conditions experienced in commercial kitchen appliances.

17. A fire suppression system, comprising:

a fire suppression delivery system for delivering fire suppression agent;

a nozzle having an inlet end configured to receive the fire suppression agent and having a discharge end with an orifice therein to dispense the fire suppression agent in a desired manner, the nozzle having an outer nozzle surface;

a blow-off cap having a closed end portion and wall portion formed together from a single piece of metal to provide an open-ended cavity shaped to receive the discharge end of the nozzle and cover the orifice, the closed end portion including a closed end that is located in close proximity to the orifice in the discharge end of the nozzle when the blow-off cap is mounted on the discharge end of the nozzle;

a receptacle formed in the outer nozzle surface of the nozzle and formed in an interior cap surface of the blow-off cap; and a retention element fit within the receptacle and engaging the outer nozzle surface and the interior cap surface to provide a predetermined amount of retention resistance to retain the blow-off cap on the nozzle, the orifice directing the fire suppression agent directly onto the closed end portion with sufficient discharge pressure to overcome the retention resistance.

18. The fire suppression system of claim 17, wherein the retention element constitutes an O-ring that provides a seal between the nozzle and the blow-off cap, the seal preventing effluent from entering a portion of the cavity within the blow-off cap.

19. The fire suppression system of claim 17, the receptacle of the blow-off cap further comprising an interior groove formed in the interior cap surface of in the cavity, the retention element constituting an O-ring fitting into the interior groove.

20. The fire suppression system of claim 17, wherein the receptacle constitutes a depth based on at least one of a thickness of the retention element and a discharge pressure.

21. The fire suppression system of claim 17, further comprising a lanyard interconnecting the blow-off cap and the nozzle.

22. The fire suppression system of claim 17, wherein the receptacle constitutes a groove having a depth and a width, wherein the retention resistance is increased by increasing one of the depth and width of the groove and decreased by decreasing one of the depth and width of the groove.

23. The fire suppression system of claim 17, wherein the fire suppression system is configured for use in a cooking appliance, the metal wall portion and closed end portion remaining rigid and withstanding extreme temperature gradients produced by the cooking appliance.

24. The fire suppression system of claim 17, wherein the single piece of metal forming the closed end portion and wall portion is able to withstand extreme temperature conditions experienced in commercial kitchen appliances, such that the retention element and receptacle maintain the predetermined amount of retention resistance when exposed to the extreme temperature conditions experienced in commercial kitchen appliances.

* * * * *